United States Patent [19]

Bolduc

[11] Patent Number: 5,018,643

[45] **Date of Patent: * May 28, 1991**

[54] AEROSOL DISPENSER WITH SEALED ACTUATOR AND AEROSOL DISPENSING METHOD

[76] Inventor: Lee R. Bolduc, 6416 Gainsborough Dr., Raleigh, N.C. 27612

[ * ] Notice: The portion of the term of this patent subsequent to Dec. 25, 2007 has been disclaimed.

[21] Appl. No.: 407,330

[22] Filed: Sep. 14, 1989

Related U.S. Application Data

[63] Continuation-in-part of Ser. No. 261,320, Oct. 24, 1988, Pat. No. 4,979,638, which is a continuation-in-part of Ser. No. 49,361, May 14, 1987, which is a continuation-in-part of Ser. No. 812,237, Dec. 23, 1985, abandoned.

[51] Int. Cl.[5] ..... B67B 7/00

[52] U.S. Cl. ..... 222/1; 222/145; 222/190; 206/219

[58] Field of Search ..... 222/1, 80, 83.5, 94, 222/129, 130, 145, 190, 394, 399; 206/219; 169/83; 239/272, 304, 309, 373

[56] References Cited

U.S. PATENT DOCUMENTS

| | | |
|---|---|---|
| 315,610 | 4/1885 | Gee . |
| 518,258 | 4/1894 | Lechartier . |
| 1,536,144 | 5/1925 | Robinson . |
| 1,587,598 | 6/1926 | Magg . |
| 1,779,959 | 10/1930 | Bellocchio . |
| 2,167,866 | 8/1939 | Bennett . |
| 2,716,637 | 8/1955 | Bunting . |
| 2,921,720 | 1/1960 | Malachick . |
| 2,930,384 | 3/1960 | Strain et al. . |
| 3,080,094 | 3/1963 | Modderno . |
| 3,240,403 | 3/1966 | Modderno . |
| 3,349,966 | 10/1967 | Schwartzman . |
| 3,491,916 | 1/1970 | Graham . |
| 3,591,089 | 7/1971 | Cronan . |
| 3,638,786 | 2/1972 | Borecki et al. . |
| 3,648,899 | 3/1972 | Lukesch et al. . |
| 3,658,719 | 4/1972 | McConnaughey . |
| 3,679,102 | 7/1972 | Charle et al. . |
| 3,718,235 | 2/1973 | Cronan . |
| 3,773,264 | 11/1973 | Cronan . |
| 3,791,980 | 2/1974 | Goldsmith . |
| 3,966,087 | 6/1976 | Curry et al. . |
| 4,121,772 | 10/1978 | Cronan . |
| 4,201,316 | 5/1980 | Klingaman . |
| 4,387,998 | 6/1983 | Szigeti . |
| 4,465,183 | 8/1984 | Saito et al. . |
| 4,491,250 | 1/1985 | Liebermann . |
| 4,613,061 | 9/1986 | Meuresch et al. . |
| 4,682,689 | 7/1987 | Pereira et al. . |

FOREIGN PATENT DOCUMENTS

| | | |
|---|---|---|
| 1168772 | 12/1958 | France . |
| 215493 | 5/1924 | United Kingdom . |

OTHER PUBLICATIONS

Aerosol Age, Sep. 1985.

*Primary Examiner*—Michael S. Huppert
*Assistant Examiner*—Gregory L. Huson
*Attorney, Agent, or Firm*—Burd, Bartz & Gutenkauf

[57] ABSTRACT

An aerosol dispenser having a transparent container for storing a propellant and a first compound under pressure. An actuator cap normally closes a valve mounted on top of the container to control the dispensing of the materials from the container. An ampule containing a second material separate from the first material until the ampule is broken is positioned generally along the bottom of the container with a saddle shaped foot. A push rod extended through the valve holds the foot in engagement with the ampule and breaks the ampule when the valve is first moved to its open position. The materials are mixed within the container and are dispensed through a filter mounted on a dip tube leading to the valve.

19 Claims, 3 Drawing Sheets

AEROSOL DISPENSER WITH SEALED ACTUATOR AND AEROSOL DISPENSING METHOD

CROSS REFERENCE TO RELATED APPLICATIONS

This application is a continuation-in-part of U.S. application Ser. No. 261,320 filed Oct. 24, 1988, now U.S. Pat. No. 4,979,638. U.S. application Ser. No. 261,320 is a continuation-in-part of U.S. application Ser. No. 049,361 filed May 14, 1987. U.S. application Ser. No. 049,361 is a continuation in part of U.S. application Ser. No. 812,237 filed Dec. 23, 1985, now abandoned.

FIELD OF INVENTION

The invention relates to an aerosol spray container and dispenser for holding materials which must normally be maintained in separated until immediately prior to use. The invention includes a method of storing and subsequently mixing and dispensing a two component material.

BACKGROUND OF INVENTION

Many compounds would be advantageously used if they could be dispensed from an aerosol container. Some of these compounds have a relatively short life and cannot be intermixed until just prior to use. Aerosol containers that include a frangible secondary container have been used to hermetically separate two chemical ingredients that must be mixed together immediately prior to spraying, such as a resinous paint and a catalyst. An inertia means, such as a steel ball, has been placed in the secondary container so that by shaking the entire aerosol container the inertia means shatters the secondary container allowing the two chemicals to be mixed together allowing a chemical mixture to be sprayed to a desired location. An example of this structure is shown by Cronan in U.S. Pat. No. 4,121,772.

SUMMARY OF INVENTION

The invention is incorporated in an aerosol package having a container storing under continuous pressure a first material and an ampule that keeps a second material separated until ready for use. A normally closed valve mounted on the container controls the flow of materials and propellant from the container. When the valve is first actuated, the ampule is broken and its contents mix with other chemicals and a propellant in the container. The ampule is made of a frangible material, such as glass. A rigid rod extends from the valve downwardly into the container. The lower end of the rod has a saddle that traps the ampule transversely against the bottom of the container. When the valve stem is depressed and opened, the rod shatters the ampule. This aerosol system allows one to use an aerosol spray containing material, such as cyanoacrylate adhesives. This material causes rapid deteriation of gaskets and has a relatively short shelf life. Actuating the valve to shatter the ampule causes the contents of the container and ampule to immediately begin flowing out through the valve and the container. A removable cap or button mounted on the discharge valve stem precludes undesirable discharge of materials and propellant from the container when the ampule is being broken. This prevents waste of expensive materials and environmental contamination. Dangerous substances are not inadvertantly released. The adhesives do not come into contact with the user's fingers in concentrated form. The contents of the container are not released before the material in the ampule and the other chemicals and propellant have had an adequate opportunity to mix. The amount of the two materials can be controlled in a precise ratio necessary for effective application. This ratio is not upset due to insufficient mixing of the two materials before dispensing the contents of the container.

The invention is directed to an aerosol dispenser that has a container for storing a propellant and materials, such as liquids and chemicals, under continuous pressure that are to be sprayed to a desired location. The dispenser stores two or more separated materials, such as liquids, that are mixed together within the container immediately prior to use. A wide range of ratios of materials can be selected by using different size ampules for storing secondary materials. The dispenser can be effectively used with an aerosol spray containing cyanoacrylates. Ampule breaking structure associated with the spray control valve is manually operated to fracture the ampule thereby allowing the materials in the ampule and container to mix with each other. An actuator button mounted on the valve stem seals the open top of the valve stem eliminating inadvertant release of the materials and allowing the materials to mix thoroughly before release. This also maintains proper mixing ratios of the materials in the container. The container can be made of transparent materials to permit visual inspection of the integrity of the ampule.

The container has an open top that is closed with a cap that supports a normally closed control valve. The control valve has a movable tubular member or stem which can be manually moved into the container to open the valve to allow propellant and material to be dispensed therefrom. An actuator cap or button frictionally mounted on the outer end of the moveable member seals the discharge passage of the tubular member. In one form of the invention, a nozzle is mounted on the end of the valve stem. A removable cap or button is positioned over the nozzle to preclude discharge of materials and propellant from the nozzle when the valve is first opened to break an ampule within the container. A frangible ampule is located within the container for storing a second material separated and isolated from the first material. The ampule is an elongated closed glass vessel that is positioned transversely along the bottom wall of the container. The ampule is broken by a rod which extends from the movable member downwardly into the container and traps the ampule against the bottom wall of the container. The rod and ampule have cooperating surfaces so that when pressure is applied to the actuator button, the movable member is moved into the chamber of the container causing the rod to depress and crush or break the ampule between the bottom wall of the container and the rod. This allows the second material to be mixed with the first material in the chamber. The inwardly movement of the movable member and rod to break the ampule also unseats the valves. However, the actuator button traps the air inside the moveable member and does not allow propellant and material to escape from the container. After the propellant and material have been properly mixed and the desired application area has been targeted, the button is removed from the top of the valve stem with the valve closed and replaced with a valve actautor cap and nozzle. The actuator cap and nozzle and valve are operated in a normal manner to dispense the mixed materials and propellant to a selected location.

A preferred embodiment of the aerosol dispenser has an elongated cylindrical transparent glass container having a bottom wall, an open top, and a chamber for storing a propellant and material, such as a liquid, under continuous pressure. A cap mounted on the container closes the open top and supports a normally closed control valve. The control valve has an upwardly directed tubular stem that can be moved relative to a seal to open the valve. An actuator button is mounted on the outer end of the stem in a tight fitting relationship actuator so that the propellant and the material cannot be dispensed from the container as long as the button is on the stem.

An elongated frangible ampule is located within the chamber for storing a second material separate and isolated from the first material. The second material in the ampule being separated and isolated from the first material in the container increases the shelf life of the product and minimizes the deteriation of the gasket and seal structures of the control valve. A rigid rod having a saddle shaped foot accommodates the mid section of the ampule to hold the ampule adjacent the bottom wall of the container. The rod is connected to the inner end of the tubular stem. When the actuator button is depressed, the tubular stem and rod are moved inwardly to force the saddle foot into the ampule to break the ampule. The second material in the ampule flows into the chamber where it is mixed with the first material and propellant. The inward movement of the tubular stem opens the valve. The actuator button is friction sealed to the outer end of the stem to prevent the propellant and materials from being dispensed from the container when the valve is first opened. This avoids product waste and inadvertant application of the materials to undesired areas. The proper mixing ratios of the propellant and materials is maintained as one of the substances is not discharged before combining with the other substances. Also, potential environmental contamination is reduced. When the mixed materials and propellant are ready to be dispensed from the container, the button is removed from the nozzle or replaced with a valve actuator nozzle to allow the release of the contents of the container. A dip tube having a filter at the lower end thereof carries the mixed materials and propellant into the valve when the valve is open thereby allowing the mixed materials to be dispensed to a desired location. The valve actuator is provided with an elongated tube which allows the materials to be accurately dispensed to a desired location.

The objects and advantages of the aerosol dispenser and method of storing and dispensing materials of the invention are embodied in the dispenser structure and functions as shown in the drawing and described in the specification of the preferred embodiments thereof.

DESCRIPTION OF PREFERRED EMBODIMENTS

Figure 1:
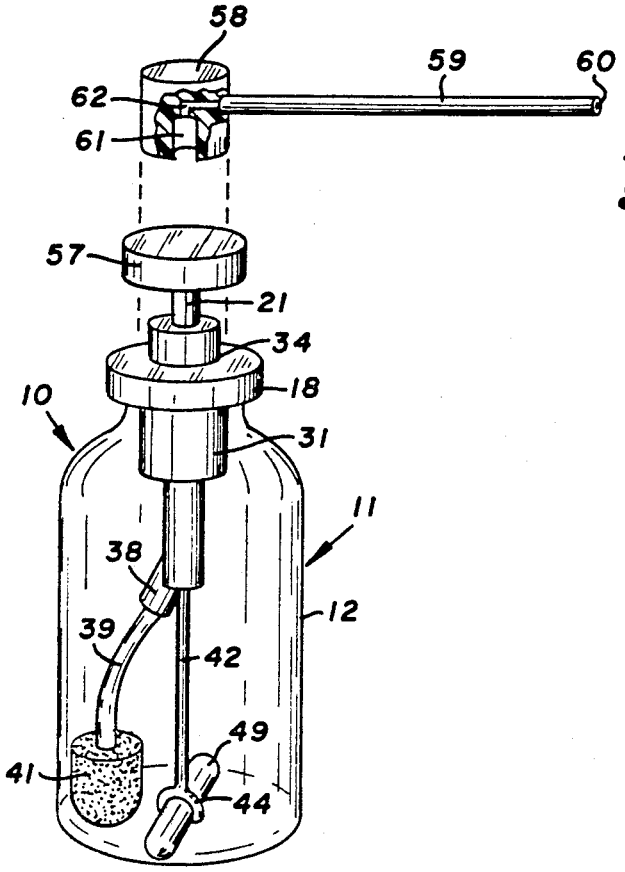
FIG. 1 is a perspective view of the aerosol dispenser of the invention selectively equipped with an actuator button and a nozzle, partly sectioned, having a dispensing tube for directing mixed materials to a desired location in lieu of the actuator button.
Figure 3:
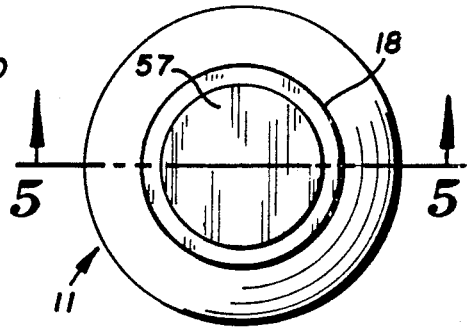
FIG. 3 is a top plan view of FIG. 2.

Referring to FIGS. 1, 2, 3 and 4, there is shown the aerosol dispenser 10 of the invention for separately storing materials, mixing the materials, and delivering mixed materials with a propellant to a desired location. The materials within dispenser 10 are isolated from each other with a container 11 with one material being under continuous pressure. The materials are mixed immediately prior to use so that corrosive materials have a minimum effect on gaskets and sealing elements of the control valve. The materials stored in dispenser 10 has substantial shelf life since there is little or no reaction within the container prior to the mixing of the materials within the container. Dispenser 10 can be used with materials such as cyanoacrylates, pharmaceutical drugs, adhesives and other two component mixtures.

Dispenser 10 has a bottle or container 11 made out of transparent material such as glass, plastic or the like. Bottle 11 has a cylindrical side wall 12 joined to a generally flat bottom wall 13. The top of side wall 12 has an annular rim or bead 14 surrounding the opening or mouth into chamber 16 of container 11. A material 17 such as a liquid, is normally stored in a chamber 16 along with a propellant which maintains material 17 under pressure within chamber 16. The propellant can be a liquified gas that continuously maintains pressure within the container. The open top of container 11 is closed with a cap 18 that supports a normally closed control valve indicated generally at 19.

Figure 5:
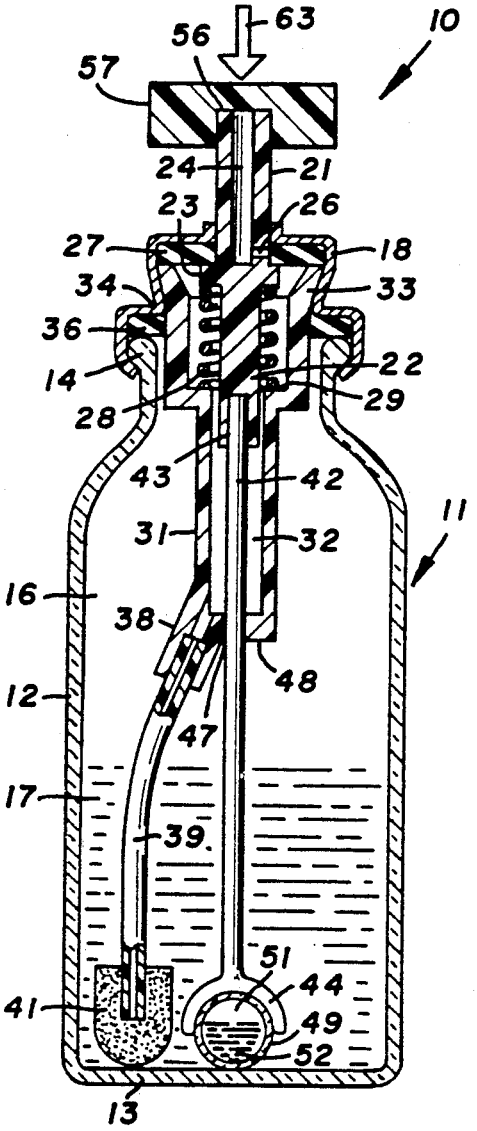
FIG. 5 is a sectional view taken along the line 5—5 of FIG. 3 showing the unbroken ampule stored in the container.
Figure 6:
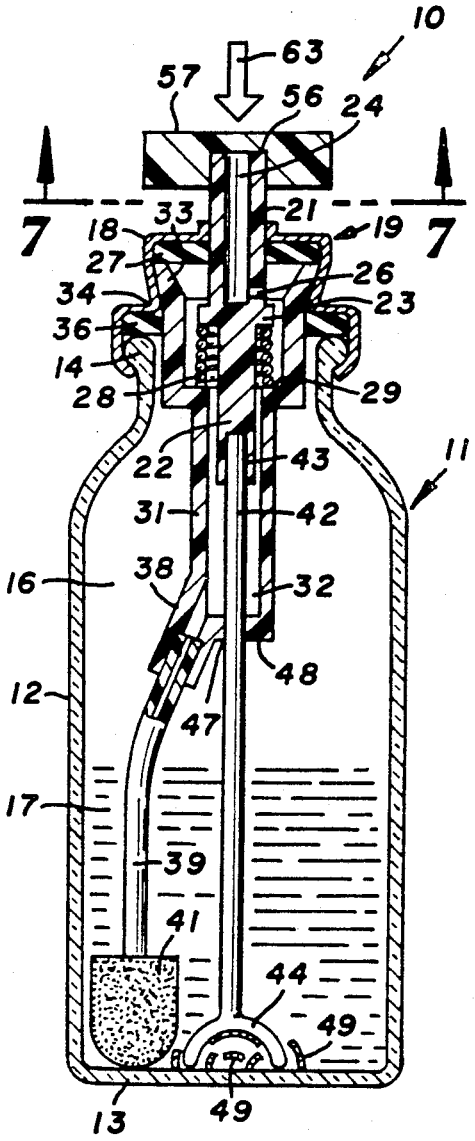
FIG. 6 is a sectional view similar to FIG. 5 showing the broken ampule.

As shown in FIGS. 5 and 6, control valve 19 has a generally upright tubular stem 21 that projects upwardly from cap 18. The lower portion of stem 21 has an elongated body 22 having an outwardly directed annular flange 23. Stem 21 has a passage 24 open to the top of stem 21 and open to a side port 26 that allows the propellant and the material to flow into passage 24. An annular diaphragm 27 surrounding stem 21 is normally aligned with side port 26 to maintain valve 19 in a closed position. A coil spring 28 engages flange 23 to hold stem 21 in an up or closed position. The lower or inner end of coil spring 28 bears against an annular shoulder 29 of a generally cup-shaped housing 31 that surrounds stem body 22. Housing 31 has an internal chamber 32 that allows the propellant and material to flow upwardly to side port 26 when control valve 19 is in the open position. Spring 28 biases stem 21 in a closed position as shown in FIG. 5. The upper end of housing 31 has an outwardly directed annular lip 33 that bears against the bottom of diaphragm 27. Cap 18 is provided with an inwardly directed annular crimp 34 to hold lip 33 in engagement with diaphragm 27. This also holds housing 31 on cap 18. An annular gasket 36 surrounds housing 31 and bears against the top of the bead 14 of container 11. Cap 18 is turned about or clamped over gasket 36 and bead 14 to seal cap 18 on container 11.

The lower portion of housing 31 has a laterally and downwardly directed nipple 38 that is secured to an elongated dip tube 39. Tube 39 extends to adjacent bottom wall 13 of container 11. A cup-shaped filter 41 fits over the lower end of dip tube 31 to prevent particulates, such as glass particles and like foreign matter, from flowing into the valve and being dispensed from the dispenser. Filter 41 is a porous polyethylene generally cylindrical member. The pore size of filter 41 is in the range of 45 to 75 microns. The bottom of filter 41 has a semi-spherical shape. The lower end of dip tube 39 fits into a hole extended down into filter 41. Other types of filters can be used with dip tube 39 to prevent foreign particles from interferring with the operation of control valve 19.

The lower portion of body 22 is secured to a downwardly directed rigid compression or push rod 42. Push rod 42 is an elongated rigid member having a smooth outer cylindrical outer surface joined to the bottom part of stem 21 so that rod 42 moves with stem 21. Rod 42 is a stainless steel wire rod having a continuous and smooth cylindrical outer surface. Other types of rigid materials can be used to make rod 42. The upper end of rod 42 is located a hole or recess 43 with a tight friction fit in the bottom of body 22. Rod 42 extends downwardly through a hole 47 in bottom wall 48 of housing 31. The smooth outer cylindrical surface of rod 42 is in a close sliding fit relation with bottom wall 48 to prevent foreign particles from entering passage 32. Spring 28 also serves as a stop to limit the depression or inward movement of stem 21. Body 22 has a diameter that is smaller than the diameter of passage 32 so that the propellant and materials can freely flow to side port 26 when port 26 is moved below diaphragm 27.

Figure 4:
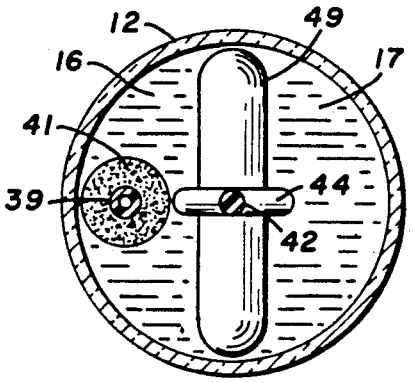
FIG. 4 is an enlarged sectional view taken along the line 4—4 of FIG. 2.

As shown in FIGS. 4 to 6, the bottom of rod 42 has a saddle shaped foot 44. Foot 44 is adapted to partially encircle and trap an elongated cylindrical frangible ampule 49 against bottom wall 13 of container 11. Ampule 49 has a sealed chamber 51 storing a second material 52 such as liquid, chemical, powders, and the like that is desired to be mixed with material 17 in chamber 16 immediately prior to use of the dispenser. Ampule 49 is a vessel of frangible material, such as glass, located generally transversely along bottom wall 13 of container 11. The diameter of ampule 49 is smaller than the diameter of the opening into chamber 16. The length of ampule 49 can be substantially the same as the transverse length or diameter of bottom wall 13. The size of ampule 49 is selected to provide the desired ratio of volumes of material 17 to material 52.

Ampule 49 is retained in its generally transverse position with foot 44. As seen in FIG. 4, foot 44 is located contiguous to the mid-section of ampule 49. Ampule 49 is not broken so that the material 52 therein is isolated from material 17 in chamber 16. The structural condition of ampule 49 can be visually observed through the transparent material of container 11.

Figure 7:
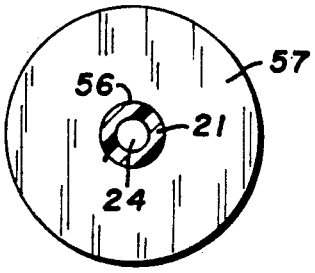
FIG. 7 is an enlarged sectional view taken along the line 7—7 of FIG. 6.

The upper end of stem 22 accommodates a generally circular button or closure cap 57 that closes passage 24. Button 57 has a centrally located hole 57. Valve stem 21 is located in a close friction fit relation with hole 56 to effectively seal passage 24, as shown in FIG. 7. Button 57 is used to apply force as indicated by arrow 63 in FIG. 5 in a downward direction on stem 21. This moves valve 19 to the open position and rod 42 in a downward direction. Continued downward movement of rod 42 continues to exert force on the ampule 49 and wedges the ampule 49 between the bottom wall 13 of container 11 and foot 44. This force of foot 44 against ampule 49 in FIG. 6, fractures or breaks ampule 49 thereby releasing material 52 into chamber 16 where it is mixed with material 17. The mixing of the materials can be facilitated by shaking dispenser 10. Button 57 prevents materials 17 and 52 and propellant from being discharged from the chamber 16. This eliminates wasted or unexpected discharge of the materials which could be expensive or dangerous. Drugs and other pharmaceutical aerosols that require exact mixing ratios to be effective would lose their effectiveness if material 17 was partially discharged before mixing with material 52 thereby upsetting the mixing ratio. Cyanoacrylate adhesives inadvertently discharged on a user's hands causes fingers to bond together and is painful and time consuming to unglue. These problems are avoided when button 57 is used on dispenser 10 while fracturing ampule 49.

After ampule 49 is broken, the external force 63 on button 57 can be removed. Spring 28 will then move stem 21 to its closed position as shown in FIG. 5. Button 57 is then removed from stem 21 and replaced with a cap actuator 58. As shown in FIG. 1, cap actuator 58 has a elongated lateral tube 59 having a discharge orifice 60. The bottom of cap 58 has a bore 61 that telescopes over the top of stem 21. Bore 61 is open to a passage 62 that leads laterally to tube 59. Other types of cap actuators and discharge nozzles can be used with stem 21 to direct the aerosol spray to desired locations.

Figure 2:
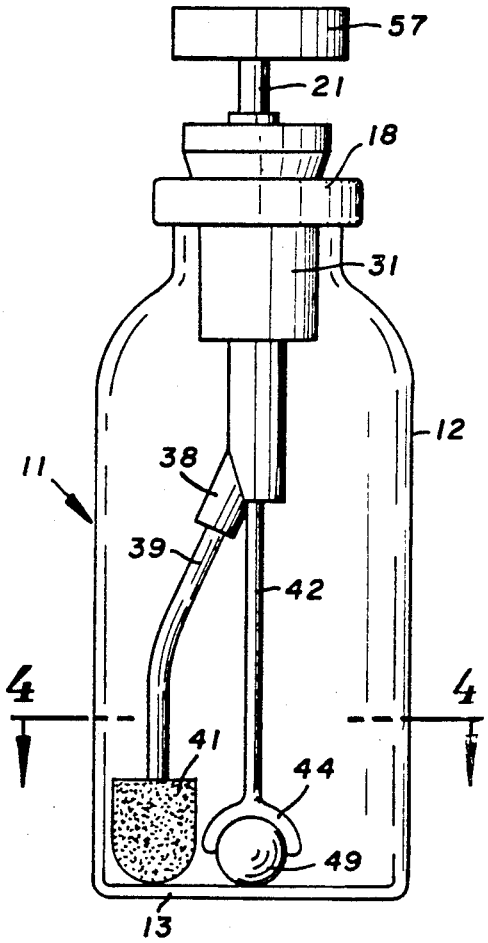
FIG. 2 is an enlarged front elevational view of the dispenser of FIG. 1.

Dispenser 10 is stored and transported in the manner shown in FIGS. 1 and 2. A cover (not shown) can be placed over button 57 and fitted on cap 18. Control valve 19 is closed thereby confining the liquid 17 and propellant to chamber 16. Ampule 49 being a hermetically sealed vessel separates and isolates the material 52 from the material from the material 17 and propellant in chamber 16. This substantially increases the shelf life of the liquids 17 and 52 and minimizes deteriation of the seal materials of the control valve 19. The separation of the first and second materials also allows the dispenser to use cyanoacrylates.

The sealed ampule 49 containing liquid 52 is placed in chamber 16 through the top opening before the cap 18 is attached to rim 14. Cap 18 and control valve 19 are placed on top of container 11 as a unit. The rod 42 extends down into chamber 16 to locate foot 44 adjacent the mid-section of ampule 49. Material 17 can be placed in chamber 16 before cap 18 is placed on container 11. Propellant can be introduced into chamber 16 through stem 21 by opening valve 19.

In use the operator applies force 63 on button 57 to move stem 21 down into container 11. This moves foot 44 down into ampule 49 to break ampule 49, as shown in FIG. 6. The material 52 in ampule 49 mixes with material 17. Button 57 prevents the materials 17 and 52 from escaping through stem passage 24. Button 57 is replaced with cap actuator 58. Dispenser is now ready for use to dispense a spray or jet of mixed materials and propellant to a location.

Figure 8:
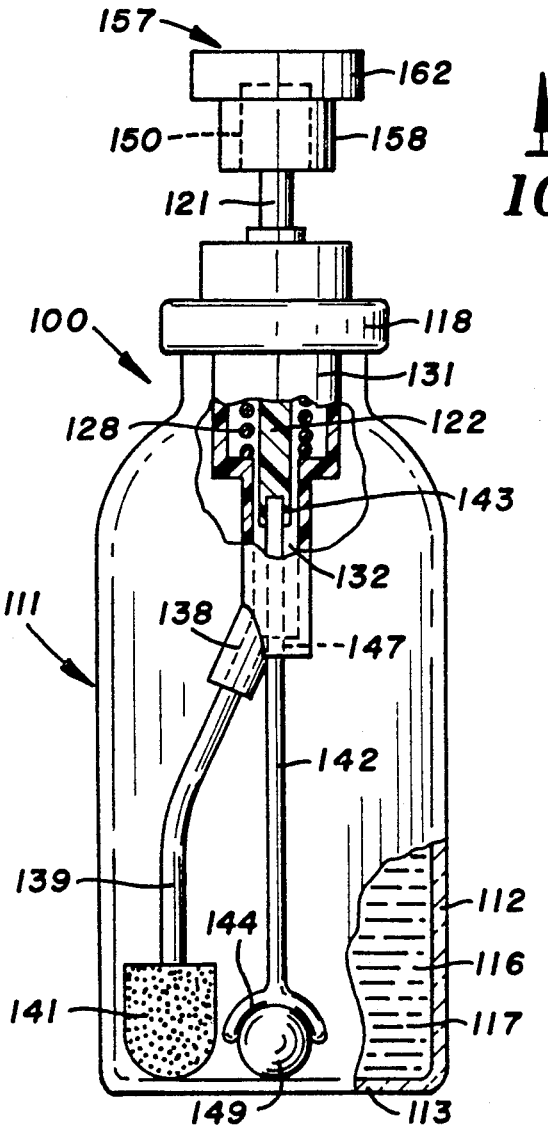
FIG. 8 is a front elevational view of a modification of the aerosol dispenser of the invention.
Figure 9:
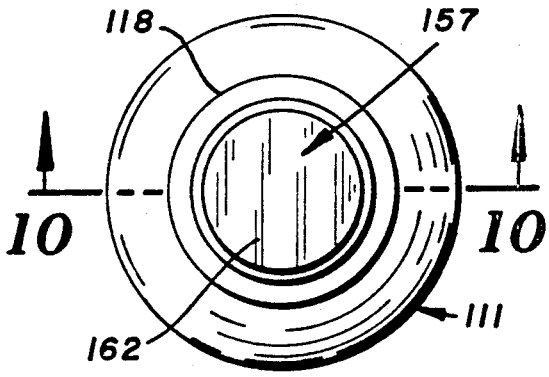
FIG. 9 is a top view of FIG. 8.
Figure 10:
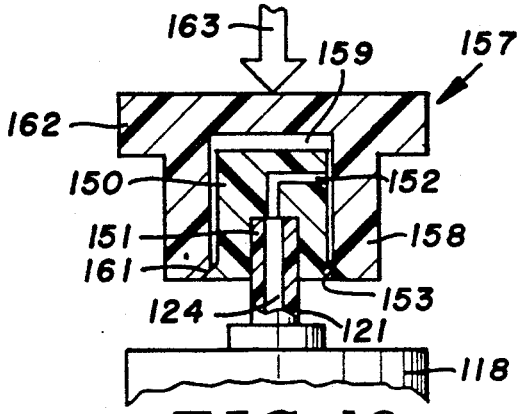
FIG. 10 is a sectional view taken along line 10—10 of FIG. 9 showing the nozzle and cap thereon.

Referring to FIGS. 8 to 10 there is shown a modification of the aerosol dispenser of the invention indicated generally at 100 for delivering a plurality of materials with a propellant to a desired location. The structure of dispenser 100 having the same parts as dispenser 10 of the same reference numeral with a prefix 1. Dispenser 100 has a transparent bottle or container 111 having a generally cylindrical side wall 112 joined to a flat bottom wall 113. Bottle 111 has an internal close chamber 116 storing a first component or material 117. The propellant can be a liquified gas that continuously maintains the pressure within container 111. Other types of propellants can be used. A cap 118 supporting a normally closed control valve (not shown) is mounted on top of container 111. Control valve has a generally upright tubular stem 121 that projects upwardly from cap 118. The lower portion of stem 121 has an elongated body 122 that extends downwardly into a housing 131. Housing 131 has a passage 132 leading to the normally closed control valve for carrying the materials and propellant to the control valve. The details of the control valve are shown in FIGS. 5 and 6 as control valve 19. As shown in FIG. 10, stem 121 has a passage 124. A nozzle 150 having a recess or pocket 151 accommodating the upper end of stem 121 is mounted on the stem 121. Nozzle 150 has a passage 152 for carrying the materials and propellant from passage 124 and discharged the same to a desired location. Nozzle 150 has a outwardly directed flanged annular edge 153 concentric with stem 121. Edge 153 can be a generally flat outwardly directed annular flange.

Figure 11:
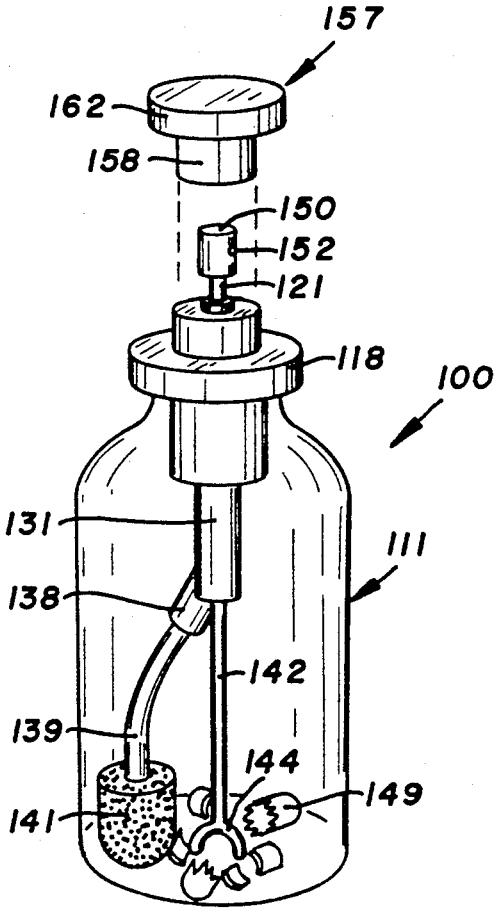
FIG. 11 is perspective view of the aerosol dispenser of FIG. 8 with the broken ampule.

Referring to FIGS. 8 and 11, a downwardly directed nipple 138 is joined to lower portion of housing 131. A dip tubed 139 joined to nipple 138 extends downwardly to a filter 141. Filter 141 is porous plastic material that allows fluids such as propellant and mixed materials to flow through dip tube 139 into the housing passage 132. Foreign particles are prevented from entering dip tube 139 by filter 141.

A downwardly directed ridged compression or push rod 141 is secured to the lower portion or body 122. Push rod 142 is an elongated ridged member having a smooth outer cylindrical surface that projected through a hole 147 in the lower end of housing 131. The outer cylindrical surface of rod 142 is in close sliding fit relation with the bottom of housing 131 to prevent foreign particles from entering passage 132. Push rod 142 is a ridged member, perferrably a stainless steel wire rod that does not react to material 117 nor propellant in chamber 116.

As shown in FIGS. 8 and 11, the lower end of push rod 142 has a saddle shaped foot 114 adapted to partically surround and trap an elongated cylindrical frangible ampule 149 against the bottom wall 113 of container 111. Ampule 149 has a seal chamber storing a second component or material such as a liquid, chemical, powders, and the like that is to be mixed with material 117 with chamber 116 immediately prior to the dispensing of the materials from the dispenser. Ampule 49 is a vessel of frangible material, such as glass, plastic, and the like located generally transversely along bottom wall 113 of container 111. The diameter of ampule 149 smaller than the diameter of the opening interchamber 116 to allow the ampula to be located within the chamber. The length of ampule 149 can be substantially the same as the transverse length or diameter of bottom wall 113. The size of ampule 149 is selected to provide a desired ratio of volumes of the materials to be mixed within the container of chamber 116.

Ampule 149 is retained and is generally transverse position with foot 144 as seen in FIG. 8. The bottom of foot 144 is spaced from bottom wall 113 to allow rod 142 to be moved in a downward direction to crush or break ampule 149 as seen in FIG. 11. Rod 142, being rigid, does not bend during its downward movement to break ampule 149. Hole 147 is not enlarged so that foreign particles do not enter chamber 132 through the hole.

Nozzle 150 is surrounded with a button or closure cap 157 that facilitates the breaking of ampule 149 by applying a downward force as indicated by arrow 163 to closure cap 157. This moves rod 142 and foot 149 in a downward direction crushing ampule 149 against bottom wall 113. The material in ampule 149 is freed to mix with material 117 in container chamber 116. The mixing can be facilitated by the shaking or turning of container 111.

Closure cap 157 has a generally cylindrical body 158 having a pocket or recess 159 that accommodates nozzle 150. The lower portion of body 158 has an outwardly flaired annular surface 161 located with an interference fit on the annular edge or lip 153 of nozzle 150. This closes pocket 159 so that the material and propellant cannot be discharged from nozzle 150 has long as the closure cap is mounted on nozzle 150. The interference fit between the annular lip 153 and annular surface 161 is less than the friction fit between nozzle 150 and stem 124 so that closure cap 157 can be removed from nozzle 150 without removing nozzle 150 from stem 121. After the ampule 149 is broken, closure cap 157 is removed from nozzle 150 thereby allowing nozzle 150 to be used to dispense material and propellant to a desired location. This is achieved by merely pressing the nozzle 150 down to open the control valve within cap 119. The mixed materials within container chamber 116 are forced by the pressure of the propellant through filter 141, dip tube 139, passage 132, control valve, stem 121, and nozzle 150 which directs the materials to the selected location.

While there has been shown and described of preferred embodiments of the aerosol dispenser of the invention it is understood that changes in the structures, arrangement of structures, and materials may be made by those skilled in the art without departing from the invention. The invention is defined in the following claims.

I claim:

1. A method of storing and subsequently dispensing a two component material comprising: storing one component of the material in an enclosed chamber of a container, said container having an open end closed with a valve having a valving member normally located in a closed position, and a nozzle mounted on the valving member, said valving member being movable from a closed position to an open position to open the valve to allow material to be dispensed from the container, continuously subjecting said one component of the material to pressure of a propellant, storing the other component of the material in a frangible ampule located in said enclosed chamber of the container, moving the valving member from the closed position to the open position to break the ampule, closing the nozzle during movement of the valving member to the open position to break the ampule to prevent the materials and propellant from being dispensed from the container, mixing the two components of the materials within said enclosed chamber, and moving the valving member from the closed position to the open position after the mixing of the two components of the material to dispense the mixed components of the material and the propellant from the container.

2. The method of claim 1 including: filtering said mixed two components of the material within the enclosed chamber before the dispensing thereof.

3. An aerosol dispenser comprising: a container having an internal chamber for storing a propellant and at least one first material under pressure, normally closed valve means mounted on said container to retain the propellant and one first material in said chamber, said valve means being movable to an open position to dispense aerosol to a desired location, frangible ampule means located with said chamber containing at least one second material that is separated from the first material within the chamber until said ampule means is broken, said valve means having a tubular stem, nozzle means mounted on the stem for directing aerosol to a selected location, means for holding the ampule means in said chamber means connected to said valve means and said means for holding the ampule means, said means connected to said valve means comprising a rigid rod extended between the valve means and means for holding the ampule means whereby when the valve means is first moved to the open position force is transmitted through the rigid rod to break the ampule means thereby releasing the second material into said chamber whereby the first and second materials are mixed within said chamber, and cap means mounted on the nozzle means for preventing discharge of materials from the nozzle means during the breaking of the ampule means, said cap means being removable from the nozzle means whereby on subsequent movement of the valve means to the open position materials are dispensed from the nozzle means.

4. The dispenser of claim 3 wherein: said valve means includes a movable body having a recess, said rod having an end located in said recess to connect the rod to the body whereby said rod is moved with the body when the valve means is moved to the open position.

5. The dispenser of claim 3 wherein: said nozzle means has an outwardly directed annular lip, said cap means having a body with a recess accommodating the nozzle means, said body having an annular surface engagable with said annular lip to seal said recess and allow the cap means to be removed from the nozzle means.

6. The dispenser of claim 2 wherein: said body has an annular end surface located in a friction fit relation with said annular lip to seal said recess and allow the cap means to be removed from the nozzle means.

7. The dispenser of claim 3 wherein: said valve means mounted on said container includes a housing having an internal passage and a movable body located in said passage, said rod connected to said valve means being movable mounted on said housing whereby when the valve means is initially moved to the open position the ampule means is broken, and means connected to said housing to carry the mixed components and propellant to said passage.

8. The dispenser of claim 7 wherein: said body has a recess, said rod having an end located in said recess to connect the rod to the body whereby said rod is moved with the body when the valve means is moved to the open position.

9. The dispenser of claim 7 wherein: the means connected to said housing includes a dip tube extended into the chamber of the container for carrying propellant and mixed components to said passage, and filter means mounted on the dip tube to prevent foreign particles from flowing into the dip tube and passage when said valve means is open.

10. An aerosol dispenser comprising: a container having a wall surrounding an internal chamber for storing a propellant and a first material under continuous pressure, normally closed valve means mounted on said container to retain the propellant and first material under continuous pressure in said chamber, said valve having a movable member for carrying propellant and material from the container, said member being movable to open the valve means to dispense aerosol to a desired location, at least one frangible ampule means located in the chamber containing a second material separate from the first material, means holding the ampule means in said chamber adjacent a wall of the chamber, means operably connected to the movable member engagable with said means for holding the ampule means operable to break said ampule means when the valve means is opened upon movement of the movable member to the open position thereof thereby releasing the second material into said chamber whereby the first and second materials are mixed together, and means mounted on the movable member to prevent propellant and materials from being dispensed from the container when the member is moved to the open position and the ampule means is being broken, said last means being removable from said movable member to allow propellant and material to be dispensed from the container when the valve means is subsequently opened.

11. The dispenser of claim 10 wherein: said means holding the ampule means includes a member having a recess accommodating a portion of the ampule means.

12. The dispenser of claim 10 wherein: said movable member includes a tubular stem projected upwardly from the valve means, said means mounted on the movable member comprising button means mounted on the stem closing said tubular stem whereby when the movable member is moved to open the valve means and break the ampule means propellant and materials are not discharged from the dispenser, said button means being removable from said stem thereby opening the tubular stem so that propellant and materials can be discharged from the dispenser when the valve means is opened.

13. The dispenser of claim 12 wherein: said button means has a recess accommodating an end portion of the tubular member with a tight fit whereby the button means is retained on the tubular member.

14. The dispenser of claim 10 including: cap means mounted on said container, a housing having an internal passage mounted on the cap means, said valve means including a movable body located in said passage, said means operatively connected to the movable member includes a rod movably mounted on said housing, and means connected to said housing to carry the mixed materials and propellant to said passage.

15. The dispenser of claim 14 wherein: the means connected to said housing includes a dip tube extended into the chamber of the container, and filter means mounted on the dip tube to prevent foreign particles from flowing into said passage when the valve means is open.

16. The dispenser of claim 14 wherein: said body has a recess, said rod having an end located in said recess to connect the rod to the body whereby said rod is moved with the body when the valve means is moved to the open position.

17. An aerosol dispenser comprising: a container having a wall surrounding an internal chamber for storing a propellant and a first material under continuous pressure, normally closed valve means mounted on said container to retain the propellant and first material under continuous pressure in said chamber, said valve having a movable member for carrying propellant and material from the container, said member being movable to open the valve means to dispense aerosol to a desired location, at least one frangible ampule means located in the chamber containing a second material separate from the first material, means holding the ampule means in said chamber adjacent a wall of the chamber, means operably connected to the movable member engagable with said means for holding the ampule means operable to break said ampule means when the valve means is opened upon movement of the movable member to the open position thereof thereby releasing the second material into said chamber whereby the first and second materials are mixed together, means associated with the movable member to prevent propellant and materials from being dispensed from the container when member is moved to the open position and the ampule means is being broken, and a nozzle mounted on the movable member for directing propellant and materials to a selected location, said means associated with the movable member to prevent propellant and materials from being dispensed from the container comprising button means mounted on the nozzle for preventing discharge of propellant and materials from the nozzle during the breaking of the ampule means, said button means being removable from the nozzle whereby on subsequent movement of the movable member to the open position materials are dispensed from the nozzle.

18. The dispenser of claim 17 wherein: said nozzle has an outwardly directed annular lip, said button means having a body with a recess accommodating the nozzle, said body having an annular surface engagable with said annular lip to seal said recess and allow the button means to be removed from the nozzle.

19. The dispenser of claim 18 wherein: said body has an annular end surface located in a friction fit relation with said annular lip to seal said recess and allow the cap means to be removed from the nozzle.

* * * * *